United States Patent [19]

Keller

[11] Patent Number: 4,844,043

[45] Date of Patent: Jul. 4, 1989

[54] ANTI VAPOR LOCK CARBURETED FUEL SYSTEM

[75] Inventor: Ronald E. Keller, Rosendale, Wis.

[73] Assignee: Brunswick Corporation, Skokie, Ill.

[21] Appl. No.: 158,331

[22] Filed: Feb. 22, 1988

[51] Int. Cl.[4] ..... F02M 34/00

[52] U.S. Cl. ..... 123/516; 123/187.5 R; 123/510

[58] Field of Search ..... 123/516, 510, 518, 73 CC, 123/73 R, 187.5 R, 73 C

[56] References Cited

U.S. PATENT DOCUMENTS

| | | | |
|---|---|---|---|
| 1,269,787 | 6/1918 | Church | 123/516 |
| 3,978,839 | 9/1976 | DuBois | 123/187.5 R |
| 4,373,479 | 8/1983 | Billingsley | 123/187.5 R |
| 4,375,206 | 3/1983 | Baltz | 123/187.5 R |
| 4,543,938 | 10/1985 | Szlaga | 123/516 |
| 4,590,897 | 5/1986 | Hundertmark . | |
| 4,699,109 | 10/1987 | Hensel . | |

OTHER PUBLICATIONS

Outboard Service Training Notebook, Brunswick Corp., Bulletin 90—90592, 2—985, pages 10-11.

*Primary Examiner*—Carl S. Miller

*Attorney, Agent, or Firm*—Andrus, Sceales, Starke & Sawall

[57] ABSTRACT

A marine fuel system includes a first crankcase pressure driven fuel pump (32) supplying fuel from a remote fuel tank (29) to a vapor separator (34), and a second crankcase pressure driven fuel pump (43) supplying vapor free fuel from the vapor separator (34) to the carburetors (18, 30) of the engine. In combination, a squeeze bulb (47) and one-way check valve (48) supply fuel from the remote fuel tank (29) directly to the carburetors (18, 30) for starting the engine.

4 Claims, 1 Drawing Sheet

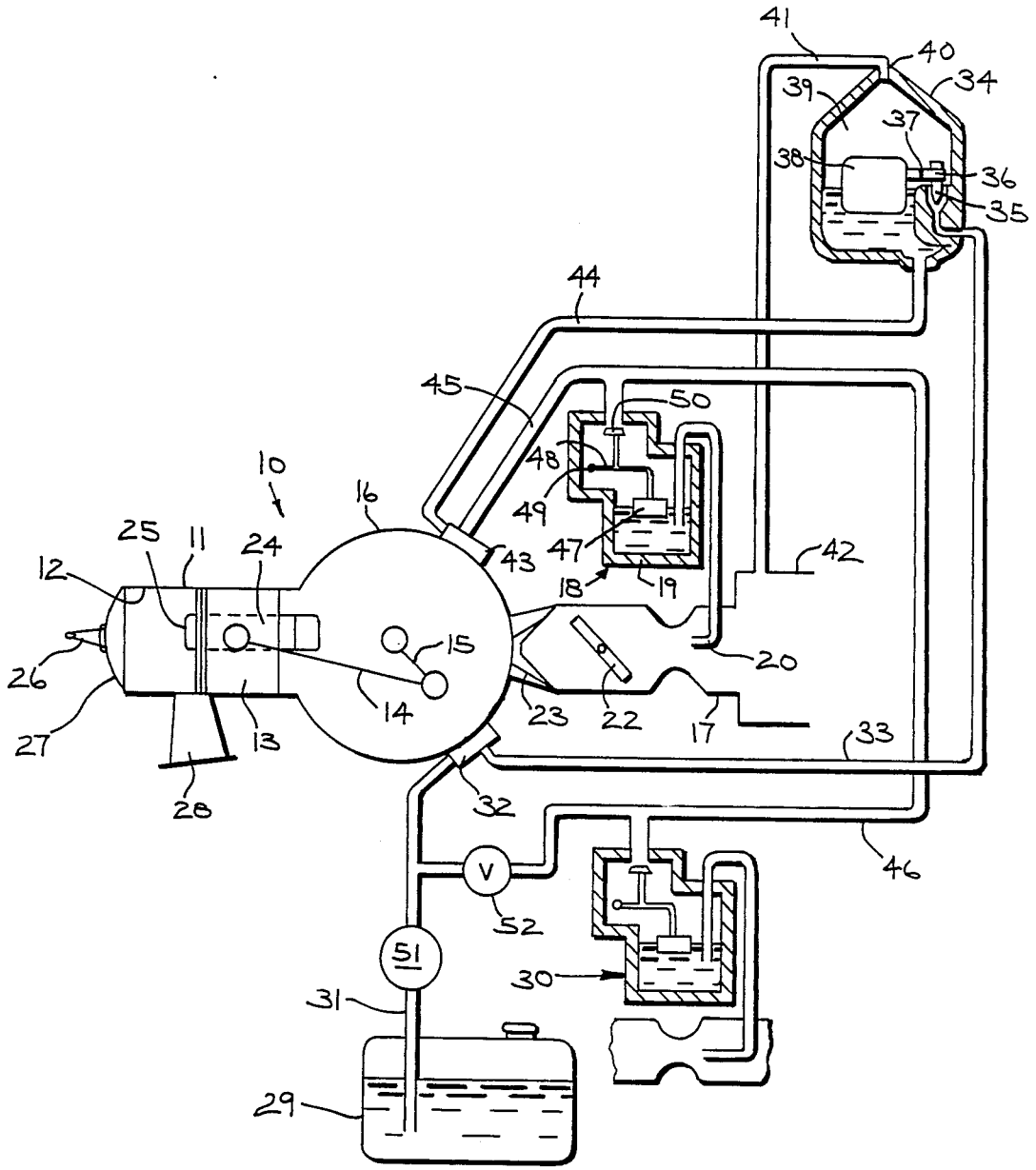
41
40
34
39
37
38
36
35
44
45
50
48
49
47
43
42
18
19
10
16
25
11
24
12
15
26
14
20
23
22
17
27
13
33
28
32
46
V
52
51
30
31
29

ANTI VAPOR LOCK CARBURETED FUEL SYSTEM

BACKGROUND AND SUMMARY

The invention relates to a marine fuel system for a carbureted engine, and more particularly to a system preventing vapor lock.

Vapor lock is a condition due to engine and/or ambient heating causing fuel vaporization which may prevent an adequate amount of fuel from being supplied to the engine.

The present invention addresses and solves the above noted problem. A vapor separator is connected in the fuel line to remove fuel vapors supplied to the carburetor. In the preferred embodiment, first and second crankcase pressure driven fuel pumps have a vapor separator therebetween for removing vapor in the fuel supplied to the carburetor. In combination, a squeeze bulb and one-way check valve provide a direct connection from a remote fuel tank to the carburetor to solve hot restart problems or otherwise provide a direct fuel supply when the normal crankcase pressure driven fuel pump is vapor locked or otherwise has reduced capacity due to fuel vaporization.

BRIEF DESCRIPTION OF THE DRAWING

The sole drawing illustrates a marine fuel system in accordance with the invention.

DETAILED DESCRIPTION

The drawing shows one cylinder of a two cycle crankcase compression internal combustion engine 10. The engine includes a cylinder block 11 having a cylinder bore 12 in which a piston 13 is supported for reciprocation. Piston 13 is connected by connecting rod 14 to crankcase shaft 15 which is journaled for rotation in crankcase 16 of engine 10. The engine includes an induction system with an air intake manifold 17 supplying air to crankcase 16. Carburetor 18 mixes fuel with the combustion air. Carburetor 18 includes a float bowl 19 supplying fuel to a carburetor jet orifice 20 at carburetor venturi 21. The flow of the fuel-air mixture into crankcase 16 is controlled by throttle valve 22. One-way reed check valve 23 permits flow from manifold 17 into crankcase 16, and prevents reverse flow out of crankcase 16 into manifold 17. A transfer passage 24 extends from crankcase 16 through cylinder block 11 and terminates at an inlet port 25 in the cylinder wall and at a point above the bottom dead center position of piston 13. A spark plug 26 is provided in the cylinder head 27 for firing the fuel-air charge. An exhause port 28 is formed in cylinder bore 12 to discharge exhaust gases.

During running of the engine, air is delivered to induction manifold 17 and fuel is admitted at carburetor jet orifice 20 to provide a fuel-air mixture which is admitted to crankcase 16 through reed valve 23 while piston 13 is moving upwardly toward spark plug 26. Reed valve 23 will open during these conditions as long as the pressure in crankcase 16 is lower than that in induction manifold 17. As piston 13 moves downwardly toward crankcase 16, exhaust port 28 will open to discharge spent combustion products, and intake port 25 will open to allow transfer or fuel-air mixture from crankcase 16 to cylinder 12. On the upstroke of piston 13, spark plug 26 is fired to ignite the mixture, and the cycle continues in conventional manner, all as is well known for a two cycle crankcase compression internal combustion engine.

A vapor free supply of fuel from a remote fuel tank 29 is provided to carburetor 18 for cylinder 12 and to other carburetors such as 30 for the other cylinders. A fuel line 31 connects fuel tank 29 to a low pressure crankcase pressure driven fuel pump 32 operated by the pulsating pressure in the engine's crankcase 16, which pump 32 draws fuel from remote fuel tank 29. Crankcase pressure driven fuel pump 32 is known in the art, and is preferably a diaphragm pump commonly used on outboard motors and produces a fuel output closely matched to engine requirements, for example a Mercury Marine Mariner fuel pump, *Outboard Service Training Notebook*, Brunswick Corp., Bulletin 90-90592 2-985, pages 10–11. Fuel line 33 supplies fuel from pump 32 to vapor separator 34. Admission of fuel from pump 32 through fuel line 33 to vapor separator 34 is controlled by valve member 35 which is controlled by a lever 36 having a pivot point 37 fixed on the vapor separator 34 and attached to a float 38. The level of fuel in vapor separator chamber 39 is controlled by the float operated valve member 35. An opening 40 at the top of vapor separator chamber 39 is connected by a line 41 to an air box 42 at the air induction end of manifold 17, which air box also services the other air intake manifolds for the remaining cylinders.

Crankcase pressure driven fuel pump 43, comparable to pump 32, draws fuel from the bottom of vapor separator 34 through fuel line 44. The fuel drawn through fuel line 44 is vapor free because fuel vapors from vapor separator 34 are drawn through line 41 to induction manifold 17. Crankcase pressure driven fuel pump 43 supplies fuel through fuel line 45 to carburetor float bowl 19, and also through fuel line 46 to the remaining carburetors such as 30 for the remaining cylinders. The operation of carburetor float bowl 19 is standard, wherein float 47 is connected by an arm 48 to a pivot point 49 to open and close an inlet port at valve seat 50 as controlled by the level of fuel in float bowl 19 in accordance with float 47.

The vapor separator also provides a fuel sump about six times as large as each of the carburetor float bowls to assure the availability of fuel even after prolonged shutdown with hot ambient temperatures.

A manually operable hand pump squeeze bulb 51 and one-way check valve 52 are connected in series between fuel tank 29 and the carburetors, for supplying fuel from fuel tank 29 directly to the carburetors for starting the engine. Squeezing of bulb 51 supplies fuel through fuel line 46 to carburetors 30 and 18. Release of bulb 51 draws fuel from fuel tank 29 through fuel line 31 into bulb 51 to replace the fuel squeezed out. Check valve 52 permits fuel flow from fuel tank 29 to the carburetors, and blocks reverse fuel flow from the carburetors to fuel tank 29. Squeeze bulb 51 ensures a direct supply of fuel to the carburetors for starting the engine, even under hot restart conditions or under other vapor lock conditions where fuel is not adequately supplied.

It is recognized that various equivalents, alternatives and modifications are possible within the scope of the appended claims.

I claim:

1. A marine fuel system for an internal combustion engine having an induction system for supplying combustion air to the engine and a carburetor for mixing fuel with the combustion air, and having a fuel tank, said fuel system comprising fuel pump means connected to draw fuel from said fuel tank and supply fuel through a fuel line to said carburetor, a vapor separator connected in said fuel line to remove fuel vapors supplied to said carburetor, wherein said fuel pump means comprises a first low pressure fuel pump connected between said fuel tank and said vapor separator and supplying fuel from said fuel tank to said vapor separator, a second low pressure fuel pump connected between said vapor separator and said carburetor and supplying fuel from said vapor separator to said carburetor, a third pump comprising a primer pump having an inlet connected to said fuel tank and having a pair of outlet branches, a first outlet branch connected to said carburetor for supplying fuel from said fuel tank directly to said carburetor for starting the engine, and a second outlet branch connected to said first fuel pump for supplying fuel from said fuel tank directly to said first fuel pump.

2. A marine fuel system for an internal combustion engine having an induction system for supplying combustion air to the engine and a carburetor for mixing fuel with the combustion air, and having a fuel tank, said fuel system comprising fuel pump means connected to draw fuel from said fuel tank and supply fuel through a fuel line to said carburetor, a vapor separator connected in said fuel line to remove fuel vapors supplied to said carburetor, wherein said fuel pump means comprises a first low pressure fuel pump connected between said fuel tank and said vapor separator and supplying fuel from said fuel tank to said vapor separator, a second low pressure fuel pump connected between said vapor separator and said carburetor and supplying fuel from said vapor separator to said carburetor, and comprising in combination a manually operable hand pump having an inlet connected to said fuel tank and having a pair of outlet branches, a first outlet branch connected to said carburetor for supplying fuel from said fuel tank directly to said carburetor for starting the engine, and a second outlet branch connected to said first fuel pump for supplying fuel from said fuel tank directly to said first fuel pump.

3. A marine fuel system for a two cycle crankcase compression internal combustion engine having an induction system for supplying combustion air to the engine and a carburetor for mixing fuel with the combustion air, and having a fuel tank, said fuel system comprising a first crankcase pressure driven fuel pump connected to draw fuel from said tank and a second crankcase pressure driven fuel pump connected to receive fuel from said first crankcase pressure driven pump and provide fuel to said carburetor, a vapor separator connected between said first and second crankcase pressure driven fuel pumps to remove fuel vapors supplied to said second crankcase pressure driven fuel pump, and comprising a manually operable hand pump and a one-way valve, said one-way valve having an inlet and an outlet and permitting fuel flow from said inlet to said outlet and blocking reverse flow, said outlet of said one-way valve being connected to said carburetor, said hand pump having an inlet connected to said fuel tank and having a pair of branch outlets, a first branch outlet connected to said inlet of said one-way valve and supplying fuel from said fuel tank directly to said carburetor through said one-way valve, a second branch outlet connected to said first fuel pump and supplying fuel from said fuel tank directly to said first fuel pump, said inlet of said one-way valve being connected to a junction between said hand pump and said first fuel pump.

4. The invention according to claim 2 comprising a one-way valve connected in series with said hand pump between said fuel tank and said carburetor and permitting fuel flow from said fuel tank to said carburetor and blocking fuel flow from said carburetor to said fuel tank, said one-way valve having an outlet connected to said carburetor and having an inlet connected to a junction between said hand pump and said first fuel pump.

* * * * *